United States Patent [19]

Nohira et al.

[11] 4,066,056

[45] Jan. 3, 1978

[54] EXHAUST GAS RECIRCULATOR

[75] Inventors: Hidetaka Nohira; Kiyoshi Kobashi; Masaaki Tanaka, all of Susono, Japan

[73] Assignee: Toyota Jidosha Kogyo Kabushiki Kaisha, Toyota, Japan

[21] Appl. No.: 629,982

[22] Filed: Nov. 7, 1975

[30] Foreign Application Priority Data

July 15, 1975 Japan ..... 50-85762

[51] Int. Cl.[2] ..... F02M 25/06

[52] U.S. Cl. ..... 123/119 A

[58] Field of Search ..... 123/179 A

[56] References Cited

U.S. PATENT DOCUMENTS

| | | | |
|---|---|---|---|
| 3,739,797 | 6/1973 | Caldwell | 123/119 A X |
| 3,756,210 | 9/1973 | Kuehl | 123/119 A |
| 3,796,049 | 3/1974 | Hayashi | 123/119 A X |
| 3,800,765 | 4/1974 | Thompson | 123/119 A |
| 3,884,200 | 5/1975 | Caldwell | 123/119 A |
| 3,888,222 | 6/1975 | Tomita | 123/119 A |

*Primary Examiner*—Charles J. Myhre
*Assistant Examiner*—Ira S. Lazarus
*Attorney, Agent, or Firm*—Stevens, Davis, Miller & Mosher

[57] ABSTRACT

An exhaust gas recirculator wherein a double diaphragm type flow control valve is disposed in a recirculating passage which couples an exhaust system and an intake or suction system of an internal combustion engine. The flow control valve includes first and second diaphragms, and is formed with a first pressure control chamber partitioned by a first diaphragm and a second pressure control chamber partitioned by the first diaphragm and a second diaphragm. Vacuum is introduced into the first and second pressure control chambers from vacuum ports provided in the vicinity of a throttle valve of a carburetor. Thus, the stroke of a valve shaft of the flow control valve and accordingly the opposing area between a valve body and valve seat of the flow control valve are controlled in two stages, so that the single flow control valve can control the amount of recirculative exhaust gas in two stages.

30 Claims, 6 Drawing Figures

EXHAUST GAS RECIRCULATOR

BACKGROUND OF THE INVENTION

This invention relates to exhaust gass recirculators, and more particularly to an exhaust gas recirculator (hereinbelow referred to as EGR) in which a double diaphragm type flow control valve permitting recirculated exhaust gas to be controlled in two stages by a single pressure control valve is disposed in a recirculating passage for coupling the exhaust system and the intake system of an internal combustion engine.

It has hitherto been well known that exhaust gas nitrogen oxides from gasoline engines, which are generally deemed one of the principal factors of air pollution, can be sharply reduced by recirculating exhaust gas. In order to hold the engine function appropriate and to enhance the reducing effect to the maximum, however, the amount of recirculation of the inactive exhaust gas needs to be delicately controlled in dependence on the running state of the vehicle or the engine. It is common practice to control the amount of recirculation of the gas in two stages in response to the running states. Therefore, two diaphragmed control valves are disposed and effect controls individually.

SUMMARY OF THE INVENTION

It is an object of this invention to provide an EGR in which, instead of the two pressure control valves in the prior art, a single pressure control valve, simple in construction and capable of lowering the cost of manufacture, is employed for the two-stage control of the amount of recirculation of the exhaust gas.

Where the pressure control valve according to this invention is used in an EGR of the type in which the recirculated exhaust gas is injected above (or upstream of) a throttle valve of a carburetor, the required amount of recirculation of the gas is ensured by increasing the exhaust gas recirculation rate in the acceleration region in which the amount of emission of $NO_x$ is large. This system is a mechanism (the so-called proportional EGR) in which the amount of recirculation of the gas, substantially proportional to the amount of intake or suction air, is ensured by keeping one throttle valve open. In order to meet a severe regulation for $NO_x$, it is required to increase the exhaust gas recirculation rate a greater amount and accordingly to provide a larger throttle valve. As a result, surging will occur at steady running. In an effort to avoid this drawback, it is necessary to make the substantial contraction of area small at the first stage and large at the second stage in the light load region (especially at steady running).

This problem has been solved by the present invention as represented by its preferred embodiment shown in FIGS. 1 to 5 of the accompanying drawing.

PREFERRED EMBODIMENTS OF THE INVENTION

Figure 1:
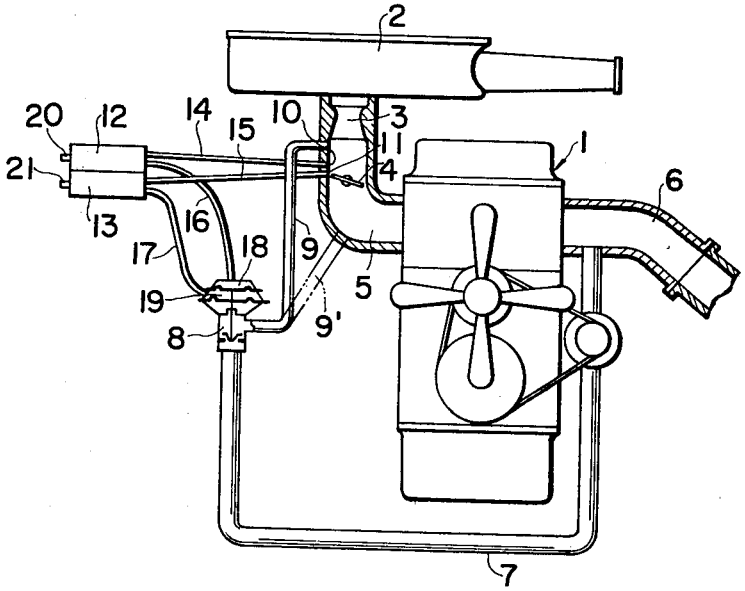
FIG. 1 is a flow diagram which shows an EGR according to this invention.

In FIG. 1 is shown an engine 1, an air cleaner 2, a Venturi portion 3 of a carburetor, and a throttle valve 4 of the carburetor. One side of the engine 1 is connected through an intake or suction pipe 5 to the air cleaner 2, while an exhaust pipe 6 is mounted on the other side thereof. Part of the exhaust gas emitted into the exhaust pipe 6 is introduced into a pressure control valve 8 by a conduit 7. Another conduit 9 introduces the part of the exhaust gas from the pressure control valve 8 into the pipe 5 at a point above the throttle valve 4 of the carburetor. Vacuum is taken out from vacuum deriving ports 10 and 11, and are conducted to magnetic valves 12 and 13 through respective rubber tubes 14 and 15. In this case, the vacuum deriving port 11 is located below the vacuum deriving port 10. The magnetic valve 12 interrupts a vacuum port signal of the vacuum deriving port 10, while the magnetic valve 13 interrupts a vacuum port signal of the vacuum deriving port 11. A rubber tube 16 connects the magnetic valve 12 and a pressure control chamber 18, while a rubber tube 17 connects the magnetic valve 13 and a pressure control chamber 19. The pressure control chamber 18 is located above the pressure control chamber 19. An atmospheric air opening portion 20 is connected with or disconnected from the pressure control chamber 18 by the operation of the magnetic valve 12, while another atmospheric air opening portion 21 is connected with or disconnected from the pressure control chamber 19 by the operation of the other magnetic valve 13.

Figure 2:
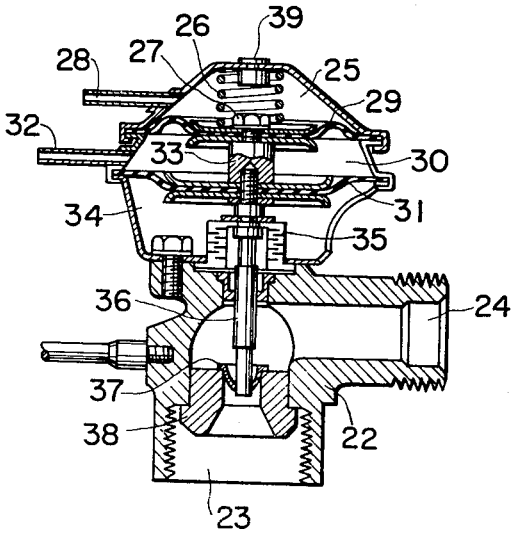
FIG. 2 is a vertical section of a pressure control valve for controlling the amount of recirculation of an exhaust gas in the EGR of this invention, FIGS. 3(*a*) and 3(*b*) are graphs of a control pressure signal and a recirculation gas proportion as are associated with the pressure control valve, respectively.

In FIG. 2 is shown a casing 22 of the pressure control valve 8, an inlet 23 for the recirculative gas, and an outlet 24 for the recirculative gas. Above the pressure control valve casing 22, there are formed a first pressure control chamber 25, a second pressure control chamber 30 and a third pressure control chamber 34 which is normally in communication with the atmospheric air. These pressure control chambers are partitioned by a diaphragm 29 and a diaphragm 31 which is somewhat larger in working area than the diaphragm 29. A spring 26 within the first pressure control chamber 25 depresses, by an initially set stress thereof, a valve body 37 which is seated on a valve seat 38 within the pressure control valve casing 22. When the valve body 37 is seated on the valve seat 38 it blocks the flow of exhaust gas through the orifice therein. The diaphragms 29 and 31 are coupled by a push rod 33 and a nut 27. The first pressure control chamber 25 is provided with a vacuum signal deriving port 28, and a stopper 39 which regulates a certain limit of movement of the shaft 36. The second pressure control chamber 30 is provided with a vacuum signal deriving port 32. The push rod 33 fixes the diaphragms 29 and 31 to the shaft 36. A bellows 35 within the third pressure control chamber 34 has one end fixed to the pressure control valve casing 22 and the other end fixed to the shaft 36. It prevents the recirculative gas from leaking to the open air.

Figure 3A:
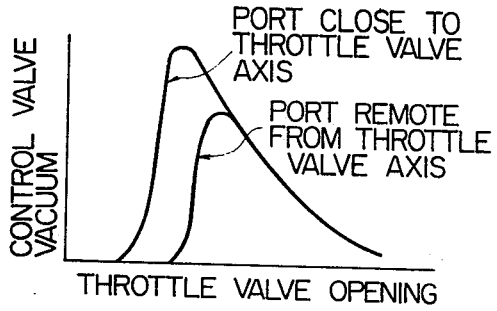
Figure 3B:
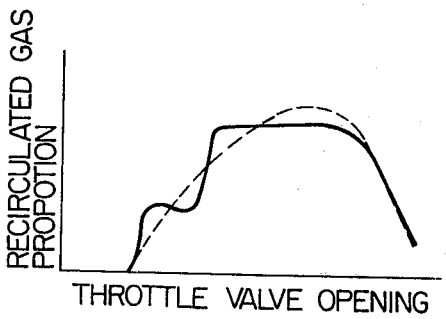

FIGS. 3(*a*) and 3(*b* ) are graphs of control pressure signals and a recirculative gas porportion of the pressure control valve 8 for the recirculative exhaust gas, respectively.

FIG. 3(*a*) shows the characteristics of the vacuum of the control valve versus the degree of opening of the throttle valve of the carburetor. As apparent from the figure, as the throttle valve is opened, the vacuum at the port close to the axis of the throttle valve is first generated, and the vacuum at the port remote from the axis of the throttle valve is subsequently generated. In this case vacuum at the remote port is less than or equal to that at the close port. FIG. 3(*b*) shows the degree of opening of the throttle valve versus the characteristic of the recirculative gas proportion in the case where the recirculative gas is injected above the throttle valve of the carburetor. Although the characteristic in a solid line deviates from an ideal exhaust gas recirculating proportion in a dashed line to some extent, it is substantially favorable.

Figure 4:
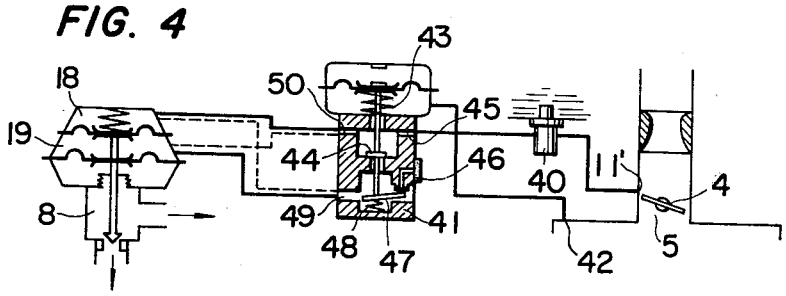
FIGS. 4 and 5 are flow diagrams which show different examples of applications of the EGR of this invention, respectively.

FIG. 4 shows an example of the application of the EGR according to this invention. A vacuum deriving port 11' is situated slightly above the full closure position of the throttle valve 4 of the carburetor. A vacuum change-over switch 40 detects engine water temperature to tightly close a passage on the side of the vacuum deriving port 11' and to open to atmospheric air a passage on the side of the change-over switch 40 (or a signal input aperture 45). A vacuum change-over valve 41 changes-over the vacuum signals in dependence on the state of the vacuum. A vacuum signal deriving port 42 takes out the vacuum signal of the intake or suction pipe 5. A valve body 44 is loaded by a spring 43. When the vacuum of the intake or suction pipe 5 is lower than a certain set value, the valve body 44 is at the closing position, and simultaneously, it depresses a plate 47 so that an atmospheric air aperture 46 and a signal output aperture 49 are in communication. The signal input aperture 45 receives a signal from the vacuum change-over switch 40. When the valve body 44 is in a drawn-up state, the plate 47 is pushed up by a spring 48 and isolates the atmospheric air aperture 46 and the signal output aperture 49 from each other. The signal output aperture 49 communicates with the second pressure control chamber 19 of the EGR gas control valve 8. Another signal output aperture 50 is normally in communication with the signal input aperture 45 and with the first pressure control chamber 18 of the EGR gas control valve 8.

Figure 5:
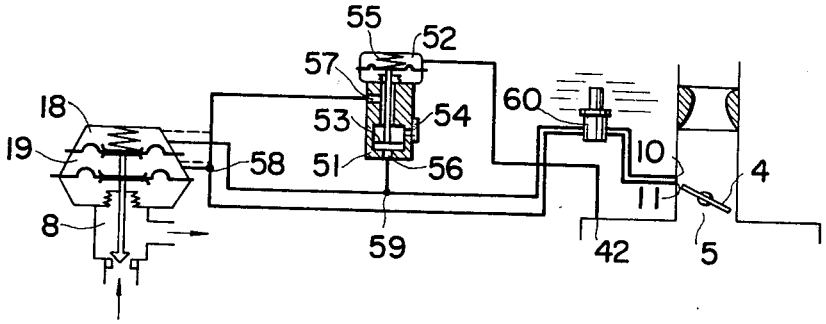

FIG. 5 illustrates another example of the application of the EGR according to this invention. A vacuum change-over valve 51 is actuated by the signal of the vacuum. A control pressure chamber 52 normally receives the vacuum signal of the suction pipe 5. When the vacuum in the suction pipe 5 is below a set value, a valve body 53 is pushed through a spring 55 and thus isolates a signal output aperture 56 and an atmospheric air aperture 54 from each other. The signal output aperture 56 is brought into or out of communication with the atmospheric air aperture 54 by the operation of the valve body 53. Another signal output aperture 57 is closed or brought into communication with the atmospheric air aperture 54 by the operation of the valve body 53. When the vacuum of the intake or suction pipe is lower than the set one, a three-way passage 58 bleeds air so as to open the second pressure control chamber 19 of the EGR control valve 8 to atmospheric air. On the other hand, when the vacuum or the intake or suction pipe 5 is higher than the set one, a three-way passage 59 bleeds air so as to open the first pressure control chamber 18 of the EGR control valve 8 to atmospheric air. A vacuum change-over switch 60 detects engine water temperature to individually open the vacuum signals of the vacuum deriving ports 10 and 11 to atmospheric air or to bring the respective vacuums into communication with the first and second pressure control chambers 18 and 19 of the EGR control valve 8.

Broken lines in FIGS. 4 and 5 indicate cases where the pressure signals to be input to the first pressure control chamber 18 and the second pressure control chamber 19 of the EGR control valve 8 are reversed as shown.

The operation of the embodiment illustrated in the flow diagrams of FIGS. 1 and 2 will now be explained for every running region of the vehicle.

1. Cranking, idling, deceleration and high load (state in which the magnetic valves 12 and 13 are not operative);

No vacuum is exerted at the vacuum deriving apertures 10 and 11 of the carburetor. At the cranking, idling, and deceleration (at which the throttle valve 4 of the carburetor is closed almost fully), the first pressure control chamber 25 and the second pressure control chamber 30 are substantially at atmospheric pressure and hence the valve body 37 is subjected only to the initial set stress of the spring 26 so that the exhaust gas is not recirculated. At the high load (at which the throttle valve 4 is fully open or at which although an end of the throttle valve is adjacent the vacuum deriving apertures 10 and 11, the vacuum at the ports is low), the vacuum to enter the first pressure control chamber 25 and the second pressure control chamber 30 is low. Forces on the diaphragms 29 and 31 are therefore smaller than the initial set stress of the spring 26, so that the valve body 37 is closed so that the exhaust gas is not recirculated.

2. Medium acceleration and steady running regions (state in which the throttle valve 4 of the carburetor comes adjacent the vacuum deriving aperture 11 and only the second control pressure chamber 30 is subjected to the vacuum, i.e., the state in which the magnetic valves 12 and 13 are not operative);

The vacuum at the vacuum deriving aperture 11 enters the second pressure control chamber 30. A force corresponding to the difference between the areas of the second diaphragm 31 and the first diaphragm 29 raises the valve body 37. The valve body 37 stops at a position at which the force is balanced to the stress of the spring 26. This operation is the so-called first stage operation of the valve body 37 and produces a small amount of exhaust gas recirculation.

3. High acceleration and steady running (high speed) regions (state in which the throttle valve 4 of the carburetor comes adjacent the vacuum deriving apertures 10 and 11 and the vacuum, being greater than that at the high load region, are exerted on the first and second pressure control chambers 25 and 30, and in which the magnetic valves 12 and 13 are not operative);

Subsequent to the state described in Item (2), the further vacuum acts on the first pressure control chamber 25. The first pressure control chamber 25 receives the vacuum at the vacuum deriving aperture 10. Overcoming the spring 26, the shaft 36 and the valve body 37 rise and are stopped by the stopper 39. The valve body 37 is then fully open. This operation is the so-called second stage operation of the valve body 37, and produces a large amount of exhaust gas recirculation.

4. Region in which the magnetic valves 12 and 13 are operative;

When electric signals are delivered to the magnetic valves 12 and 13 by switches for detecting the engine water temperature, the car speed, the position of a change gear shift lever, etc., the first and second pressure control chambers 25 and 30 are communicated to atmospheric air, and the sides of the rubber tubes 14 and 15 are shut off. This state is the same as described in Item (1) and the recirculative gas is cut off by the valve body 37. The function is not spoilt at all even when the switches are of the type which detect the temperature, the car speed etc. and directly change-over the control pressure circuits.

The operation of the embodiment illustrated in the flow diagram of FIG. 4 will now be explained for every running region of the vehicle. The operation of the EGR control valve 8 is essentially the same as that described above in connection with the flow diagrams of FIGS. 1 and 2.

1. Cranking, idling, deceleration, and high load (at which the vacuum change-over switch 40 communicates with the vacuum deriving aperture 11' and the signal input aperture 45);

The vacuum deriving aperture 11' is substantially under atmospheric pressure. At cranking and high load, the vacuum at the intake or suction pipe 5 is low, and hence, the valve body 44 closes. As a consequence, the second pressure control chamber 19 communicates with the atmospheric air aperture 46, while the first pressure control chamber 18 communicates with the vacuum deriving aperture 11'. At idling and deceleration, the vacuum at the suction pipe 5 is high, and hence, the valve body 44 is pushed upwards. As a consequence, both the first pressure control chamber 18 and the second pressure control chamber 19 communicate with the vacuum deriving aperture 11'. In either case, the first pressure control chamber 18 and the second pressure control chamber 19 are under very little vacuum or close to atmospheric pressure. The valve body 37 is closed by the control spring 26, and the exhaust gas is not recirculated, i.e., the EGR is in the "off" state.

2. Medium load and steady running regions (state in which the throttle valve 4 of the carburetor comes to the vacuum deriving aperture 11'; and the set vacuum is exceeded, and in which the vacuum change-over switch 40 is in the same condition as in Item (1));

In this state, where the vacuum in the suction pipe 5 is higher than the set value, the valve body 44 is pushed down overcoming the spring 43 of the vacuum change-over valve 41. As a consequence, the second pressure control chamber 19 communicates with the atmospheric air aperture 46 and is under atmospheric pressure, while the first pressure control chamber 18 communicates with the vacuum deriving aperture 11'. In this state, the recirculative gas is controlled in such manner that the diaphragm 31 acts on the valve body 37 by the component of its areal difference from that of the diaphragm 29 owing only to the vacuum signal of the first pressure control chamber 18. Further, when the vacuum at the intake or suction pipe 5 becomes lower than the set value, the valve body 44 is controlled by the spring 43 of the vacuum change-over valve 41 and is pushed up. Both the first pressure control chamber 18 and the second pressure control chamber 19 receive the vacuum signal at the vacuum deriving aperture 11'. The recirculative gas is controlled in such manner that the valve body 37 is subjected to a force corresponding to the area of the diaphragm 31 and is further raised. The operation is the so-called two-stage control.

3. Case where the vacuum change-over switch 40 shuts off the side of the vacuum deriving aperture 11' and opens the side of the signal input aperture 45 to atmospheric air;

Regardless of the vacuum in the intake or suction pipe 5, both the first pressure control chamber 18 and the second pressure control chamber 19 are under atmospheric pressure as in the state described in Item (1), and no exhaust gas is recirculated.

The operation of the embodiment illustrated in the flow diagram of FIG. 5 will now be explained for every running region of the vehicle. The operation of the EGR control valve 8 is essentially the same as that described previously in connection with the flow diagrams of FIGS. 1 and 2.

1. Cranking, idling, deceleration and high load (state in which the vacuum change-over switch 60 brings the vacuum deriving aperture 10 and the three-way passage 59, and the vacuum deriving aperture 11 and the three-way passage 58 into communication with each other, that is, the state in which the throttle valve 4 of the carburetor does not move adjacent the vacuum deriving apertures 10 and 11 and is substantially fully closed);

The vacuum at both of the vacuum deriving apertures 10 and 11 is close to atmospheric pressure. Regardless of the vacuum in the suction pipe 5, both the first pressure control chamber 18 and the second pressure control chamber 19 are close to atmospheric pressure. The valve body 37 of the EGR control valve 8 is closed, so that the exhaust gas is not recirculated.

2. Medium load and steady running regions (state in which the throttle valve 4 of the carburetor comes adjacent the vacuum deriving aperture 11 and only the second pressure control chamber 19 is subjected to the vacuum, and in which the condition of the vacuum change-over switch 60 is the same as set forth in Item (1));

Since the set vacuum of the suction pipe 5 is exceeded, the valve body 53 of the vacuum change-over valve 51 is in a raised position. The first pressure control chamber 18 is bled by air and is at atmospheric pressure. The second pressure control chamber 19 receives the vacuum signal of the vacuum deriving aperture 11 because the signal output aperture 57 is closed. The EGR control valve 8 is operated by this signal only, and a comparatively small amount of exhaust gas is recirculated.

3. High acceleration and steady running (high speed) regions (state in which the throttle valve 4 of the carburetor comes immediately adjacent the vacuum deriving apertures 10 and 11 and the vacuum at both the apertures is higher than the set one, and in which the condition of the vacuum change-over switch 60 is the same as described in Item (2));

Since the valve body 53 of the vacuum change-over valve 51 is lowered, the second pressure control chamber 19 is bled by air and is at atmospheric pressure. The first pressure control chamber 18 receives the vacuum signal of the vacuum deriving aperture 10 because the signal output aperture 56 is closed. The EGR control valve 8 is operated by this signal only, and a comparatively large amount of exhaust gas is recirculated.

4. Case where the vacuum change-over switch 60 shuts off the side of the vacuum deriving apertures 10 and 11 and brings the side of the control chambers of the EGR control valve 8 to atmospheric pressure;

Regardless of the vacuum in the intake pipe 5 and at the vacuum deriving apertures 10 and 11, both the first pressure control chamber 18 and the second pressure control chamber 19 are at atmospheric pressure, and no exhaust gas is recirculated.

Aspects of performance to be included within the scope of this invention are summarized below.

In each of the exhaust gas recirculators defined in this invention, magnetic valves which operate in dependence on the running state of the engine, vacuum change-over valves which change-over vacuum passages by utilizing, for example, the thermal expansion of a wax, or the like means are disposed in conduits which communicate with the first and second pressure control chambers of the pressure control valve and with a portion of the intake pipe adjacent the throttle valve of the carburetor, so that the pressure control chambers are brought to atmospheric pressure when the recirculation of the exhaust gas is unnecessary in view of control factors such as engine water temperatures and car speed.

What we claim is:

1. An exhaust gas recirculator comprising:

a double diaphragm control valve positioned in a recirculation passage coupling an exhaust system and an intake system of an internal combustion engine, said valve comprising:

a valve shaft, a valve seat, a valve body on one end of said shaft for seating on said valve seat, a first diaphragm and a second diaphragm, the center of each of which is fixed to the valve shaft, said second diaphragm having a larger cross-sectional area than that of said first diaphragm, means, including said first diaphragm, defining a first pressure control chamber, a spring in said first pressure control chamber, said spring biassing said valve shaft and valve body thereon toward a position in which said valve body is seated on said valve seat, means, including said first diaphragm and said second diaphragm, defining a second pressure control chamber, and the surface of said second diaphragm which is exterior to the second pressure control chamber being in fluid communication with atmospheric air whereby when vacuum is selectively introduced into said chambers, the movement of the valve shaft is controlled in two stages and the spacing of the valve body from the valve seat is changed in two stages so that the flow rate of recirculated exhaust gas can be regulated in two stages.

2. An exhaust gas recirculator comprising:

a pressure control valve for controlling the amount of recirculative exhaust gas in two stages, said valve being positioned in a recirculation passage coupling an exhaust system and an intake system of an internal combustion engine, said valve comprising:

means defining a first pressure control chamber therein, means defining a second pressure control chamber therein, means for fluidly connecting said second pressure control chamber to a first vacuum port, in the intake system of the internal combustion engine, slightly above the fully closed position of a throttle valve of a carburetor, and means for fluidly connecting said first pressure control chamber to a second vacuum port in the intake system slightly above said first vacuum port so that the vacuum at each of said ports which is communicated to said chambers is controlled by the degree of opening of the throttle valve.

3. An exhaust gas recirculator as claimed in claim 2, wherein:

said control valve further comprises:

a housing, a first diaphragm in said housing, and a second diaphragm in said housing, said second diaphragm being spaced from said first diaphragm, said second diaphragm having a larger cross-sectional area than that of said first diaphragm, said means defining said first pressure control chamber comprising said first diaphragm and one end of said housing, and said means defining said second pressure control chamber comprising said first diaphragm, said second diaphragm and said housing.

4. An exhaust gas recirculator comprising:

a pressure control valve for controlling the amount of recirculative exhaust gas in two stages, and valve being positioned in a recirculation passage coupling an exhaust system and an intake system of an internal combustion engine, said valve comprising means defining a first pressure control chamber therein and means defining a second pressure control chamber therein, a vacuum circuit, including a vacuum change-over valve, for fluidly communicating said pressure control valve, including said first pressure control chamber therein and said second pressure control chamber therein, to a vacuum port, in the intake system of the internal combustion engine, slightly above the fully closed position of a throttle valve of a carburetor so that vacuum at the port is communicated to said first pressure control chamber when the vacuum of the engine is high and the vacuum at the port is communicated to both said first pressure control chamber and said second pressure control chamber when the vacuum is low whereby the flow rate of recirculated exhaust gas is controlled dependent upon the load on the engine.

5. An exhaust gas recirculator as claimed in claim 4, wherein:

said control valve further comprising:

a housing, a first diaphragm in said housing, and a second diaphragm in said housing, said second diaphragm being spaced from said first diaphragm, said second diaphragm having a larger cross-sectional area than that of said first diaphragm, said means defining said first pressure control chamber comprising said first diaphragm and one end of said housing, and said means defining said second pressure control chamber comprising said first diaphragm, said second diaphragm and said housing.

6. An exhaust gas recirculator comprising:

a pressure control valve for controlling the amount of recirculative exhaust gas in two stages, said valve being positioned in a recirculation passage coupling an exhaust system and an intake system of an internal combustion engine, said valve comprising means defining a first pressure control chamber and means defining a second pressure control chamber, a vacuum circuit, including a vacuum change-over valve, for fluidly communicating said pressure control valve, including said first pressure control chamber and said second pressure control chamber, to a first vacuum port, in the intake system of the internal combustion engine, slightly above the fully closed position of a throttle valve of a carburetor, and to a second vacuum port, in the intake system of the internal combustion engine, slightly above said first vacuum port, said first pressure control chamber being fluidly communicated with vacuum at the first vacuum port when the vacuum of the engine is high, said second pressure control chamber being fluidly communicated with vacuum at the second vacuum port when the vacuum of the engine is low so that the vacuum at each of said ports is controlled by the degree of opening of the throttle valve.

7. An exhaust gas recirculator as claimed in claim 6, wherein:

said control valve further comprises:

a housing, a first diaphragm in said housing, and a second diaphragm in said housing, said second diaphragm being spaced from said first diaphragm, said second diaphragm having a larger cross-sectional area than that of said first diaphragm, said means defining said first pressure control chamber comprising said first diaphragm and one end of said housing, and said means defining said second pressure control chamber comprising said first diaphragm, said second diaphragm and said housing.

8. In an internal combustion engine having an intake system, an exhaust system and a recirculation passage through which exhaust gas from the exhaust system may be recirculated to the intake system, the improvement comprising:

a control valve in said passage for controlling the amount of recirculation exhaust gas in two stages, said valve comprising:

a valve seat, a valve body for seating on said seat to thereby close said valve and block said passage and simultaneously block recirculation of exhaust gas, means defining a first pressure control chamber therein, means defining a second pressure control chamber therein, means connecting said valve body to the means defining the first pressure control chamber and the means defining the second pressure control chamber, means for fluidly communicating said first pressure control chamber and said intake system, and means for fluidly communicating said second pressure control chamber and said intake system whereby when vacuum is selectively introduced into said chambers from the intake system, the movement of the valve body from the valve seat is controlled in two stages and the spacing of the valve body from the valve seat is changed in two stages so that the flow rate of recirculated exhaust gas can be regulated in two stages.

9. In an internal combustion engine as claimed in claim 8, wherein:

said valve further comprises:

a first diaphragm, and a second diaphragm spaced from said first diaphragm, said second diaphragm being of larger cross-sectional area than that of the first diaphragm, said means defining said first pressure control chamber comprises said first diaphragm, and said means defining said second pressure control chamber comprises said first diaphragm and said second diaphragm.

10. In an internal combustion engine as claimed in claim 9, wherein:

the surface of said second diaphragm exterior to said second pressure control chamber being in fluid communication with atmospheric air.

11. In an internal combustion engine as claimed in claim 9, wherein:

said means connecting said valve body to the means defining the first pressure control chamber and the means defining the second pressure control chamber comprises:

a valve shaft, one end of which is connected to the valve body and the other end of which is connected to the second diaphragm, and a rod in said second pressure control chamber, one end of said rod being connected to said first diaphragm and the other end of said rod being connected to said second diaphragm.

12. In an internal combustion engine as claimed in claim 11, further comprising:

a spring in said first pressure control chamber for biassing said valve body toward a position in which it is seated on said valve seat.

13. In an internal combustion engine having an intake system including a carburetor having a throttle valve, an exhaust system and a recirculation passage through which exhaust gas from the exhaust system may be recirculated to the intake system, the improvement comprising:

means defining a first vacuum port in said intake system adjacent to but slightly above the fully closed position of the throttle valve, means defining a second vacuum port in said intake system slightly above said first vacuum port, a control valve in said passage for controlling the amount of recirculative exhaust gas in two stages, said valve comprising:

a valve seat, a valve body for seating on said seat to thereby close said valve and block said passage and simultaneously block recirculation of exhaust gas, a first diaphragm, a second diaphragm spaced from said first diaphragm, said second diaphragm being of larger corss-sectional area than that of said first diaphragm, means, including said first diaphragm, defining a first pressure control chamber therein, means, including said first diaphragm and said second diaphragm, defining a second pressure control chamber therein, means connecting the valve body to the first diaphragm and the second diaphragm, means for fluidly communicating said first pressure control chamber to said second vacuum port, and means for fluidly communicating said second pressure control chamber to said first vacuum port whereby when vacuum is introduced into said first and second chambers from said second and first vacuum ports respectively, the movement of the valve body from the valve seat is controlled in two stages and the spacing of the valve body from the valve seat is changed in two stages so that the flow rate of recirculated exhaust gas can be regulated in two stages.

14. In an internal combustion engine as claimed in claim 13, wherein:

the surface of said second diaphragm exterior to said second pressure control chamber being in fluid communication with atmospheric air.

15. In an internal combustion engine as claimed in claim 13, wherein:

said means connecting said valve body to the means defining the first pressure control chamber and the means defining the second pressure control chamber comprises:

a valve shaft, one end of which is connected to the valve body and the other end of which is connected to the second diaphragm, and a rod in said second pressure control chamber, one end of said rod being connected to said first diaphragm and the other end of said rod being connected to said second diaphragm.

16. In an internal combustion engine as claimed in claim 15, further comprising:

a spring in said first pressure control chamber for biassing said valve body toward a position in which it is seated on said valve seat.

17. In an internal combustion engine having an intake system including a carburetor having a throttle valve, an exhaust system and a recirculation passage through which exhaust gas from the exhaust system may be recirculated to the intake system, the improvement comprising:

means defining a vacuum port in said intake system adjacent to but slightly above the fully closed position of the throttle valve, a control valve in said passage for controlling the amount of recirculative exhaust gas in two stages, said valve comprising:

means defining a first pressure control chamber therein, and means defining a second pressure control chamber therein, a vacuum circuit, including a vacuum change-over valve, for fluidly communicating said vacuum port with said first pressure control chamber and said second pressure control chamber so that vacuum at the port is communicated to said first pressure control chamber when the vacuum of the engine is high and the vacuum at the port is communicated to both said first pressure control chamber and said second pressure control chamber when the vacuum is low whereby the flow rate of recirculated exhaust gas is controlled dependent upon the load on the engine.

18. In an internal combustion engine as claimed in claim 17, further comprising:

means defining a second vacuum port in said intake system downstream of said first-mentioned vacuum port, means for fluidly communicating said second vacuum port and said vacuum change-over valve.

19. In an internal combustion engine as claimed in claim 18, wherein:

said vacuum circuit further comprises a vacuum change-over switch, between said change-over valve and said first-mentioned vacuum port, for measuring the temperature of coolant in the engine and for selectively opening and closing fluid communication between the first-mentioned vacuum port and the change-over valve in response to that measurement.

20. In an internal combustion engine as claimed in claim 17, wherein:

said control valve further comprises:

a first diaphragm, and a second diaphragm spaced from said first diaphragm, said second diaphragm having a larger cross-sectional area than that of said first diaphragm, said means defining said first pressure control chamber comprises said first diaphragm, and said means defining said second pressure control chamber comprises said first diaphragm and said second diaphragm.

21. In an internal combustion engine as claimed in claim 20 wherein:

the surface of said second diaphragm exterior to said second pressure control chamber being in fluid communication with atmospheric air.

22. In an internal combustion engine as claimed in claim 20, wherein:

said control valve further comprises:

a valve seat, a valve body for seating on said seat to thereby close said control valve and block said passage and simultaneously block recirculation of exhaust gas, a valve shaft, one end of which is connected to the valve body and the other end of which is connected to the second diaphragm, and a rod in said second pressure control chamber, one end of said rod being connected to said first diaphragm and the other end of said rod being connected to said second diaphragm.

23. In an internal combustion engine as claimed in claim 22, further comprising:

a spring in said first pressure control chamber for biassing said valve body toward a position in which it is seated on said valve seat.

24. In an internal combustion engine having an intake system including a carburetor having a throttle valve, an exhaust system and a recirculation passage through which the exhaust gas from the exhaust system may be recirculated to the intake system, the improvement comprising:

means defining a first vacuum port in the intake system adjacent to but slightly above the fully closed position of the throttle valve, means defining a second vacuum port in the intake system slightly above the first vacuum port, a control valve in said passage for controlling the amount of recirculative exhaust gas into two stages, said control valve comprising:

means defining a first pressure control chamber therein, and means defining a second pressure control chamber therein, a vacuum circuit, including a vacuum change-over valve, for fluidly communicating said first vacuum port and said first pressure control chambers and for fluidly communicating said second vacuum port to said second pressure control chamber, said first pressure control chamber being fluidly communicated with vacuum at the first vacuum port when the vacuum of the engine is high, and said second pressure control chamber being fluidly communicated with vacuum at the second vacuum port when the vacuum of the engine is low so that the vacuum at each of said ports is controlled by the degree of opening of the throttle valve.

25. In an internal combustion engine as claimed in claim 24, further comprising:

means for defining a third vacuum port in said intake system downstream of said first and second vacuum ports.

26. In an internal combustion engine as claimed in claim 25, wherein:

said vacuum circuit further comprises a vacuum change-over switch, between the first vacuum port and both the vacuum change-over valve and the first pressure control chamber and between the second vacuum port and both the vacuum change-over valve and the second pressure control chamber, for measuring the temperature of coolant in the engine and for selectively opening and closing fluid communication between the first vacuum port and both the vacuum change-over valve and the first pressure control chamber and between the second vacuum port and both the vacuum change-over valve and the second pressure control chamber in response to that measurement.

27. In an internal combustion engine as claimed in claim 24, wherein:

said control valve further comprises:

a first diaphragm, and a second diaphragm spaced from said first diaphragm, said second diaphragm having a larger cross-sectional area than that of said first diaphragm, said means defining said first pressure control chamber comprises said first diaphragm, and said means defining said second pressure control chamber comprises said first diaphragm and said second diaphragm.

28. In an internal combustion engine as claimed in claim 27, wherein:

the surface of said second diaphragm exterior to said second pressure control chamber being in fluid communication with atmospheric air.

29. In an internal combustion engine as claimed in claim 27, wherein:

said control valve further comprises:

a valve seat, a vlave body for seating on said seat to thereby close said control valve and block said passage and simultaneously block recirculation of exhaust gas, a valve shaft, one end of which is connected to the valve body and the other end of which is connected to the second diaphragm, and a rod in said second pressure control chamber, one end of said rod being connected to said first diaphragm and the other end of said rod being connected to said second diaphragm.

30. In an internal combustion engine as claimed in claim 29, further comprising:

a spring in said first pressure control chamber for biassing said valve body toward a position in which it is seated on said valve seat.

* * * * *